US007029427B2

(12) United States Patent
Vuurmans et al.

(10) Patent No.: US 7,029,427 B2
(45) Date of Patent: Apr. 18, 2006

(54) WEIGHT TRAINING MACHINE FOR EXERCISING THE UPPER CHEST MUSCLES

(75) Inventors: Henri Vuurmans, Galax, VA (US); Gregory M. Webb, Independence, VA (US)

(73) Assignee: Nautilus Human Performance Systems, Inc., Independent, VA (US)

( * ) Notice: Subject to any disclaimer, the term of this patent is extended or adjusted under 35 U.S.C. 154(b) by 491 days.

(21) Appl. No.: 10/011,688

(22) Filed: Nov. 13, 2001

(65) Prior Publication Data

US 2002/0198088 A1 Dec. 26, 2002

Related U.S. Application Data

(60) Provisional application No. 60/299,676, filed on Jun. 20, 2001.

(51) Int. Cl.
*A63B 21/062* (2006.01)
*A63B 23/12* (2006.01)

(52) U.S. Cl. ..... 482/100; 482/136; 482/139

(58) Field of Classification Search ..... 482/136–139, 482/92–94, 97–100, 129, 130, 142; D21/673
See application file for complete search history.

(56) References Cited

U.S. PATENT DOCUMENTS 3,759,512 A * 9/1973 Yount et al. ..... 482/62
4,505,475 A * 3/1985 Olschansky et al. ..... 482/100
D306,050 S * 2/1990 Brentham ..... D21/676
5,120,289 A * 6/1992 Yu ..... 482/137
5,221,245 A * 6/1993 Yeh ..... 482/138
5,290,214 A * 3/1994 Chen ..... 482/137
5,330,408 A * 7/1994 Westmoreland, Jr. ..... 482/141
5,456,644 A * 10/1995 Hecox et al. ..... 482/127
5,562,577 A * 10/1996 Nichols et al. ..... 482/97
5,580,341 A * 12/1996 Simonson ..... 482/100
5,616,111 A * 4/1997 Randolph ..... 482/133
5,665,036 A * 9/1997 Hsieh ..... 482/100
6,120,421 A * 9/2000 Kuo ..... 482/111

(Continued)

FOREIGN PATENT DOCUMENTS

FR 2612406 A1 * 9/1988

(Continued)

OTHER PUBLICATIONS

Body Masters MD 504 Pec Contractor & Rear Deltoid machine, brochure 1994.*

(Continued)

*Primary Examiner*—Stephen K. Cronin
*Assistant Examiner*—Victor K. Hwang
(74) *Attorney, Agent, or Firm*—Myers Bigel Sibley & Sajovec

(57) ABSTRACT

An exercise machine includes: a frame configured to rest on an underlying surface; a seat mounted to the frame; a backrest mounted to the frame above the seat, the seat and backrest being configured to receive a seated user; a pair of movement arm units pivotally interconnected with the frame and movable about respective generally parallel first and second axes of rotation; and a resistance system connected with the movement arm units. Each of the movement arms is configured to engage at least one of the elbows, forearms and hands of the user and is movable, within a range of motion plane that is generally normal to the first and second axes of rotation, between an extended position and a flexed position. The range of motion plane forms an angle of between about 30 and 80 degrees with the backrest.

26 Claims, 5 Drawing Sheets

U.S. PATENT DOCUMENTS 6,471,624 B1 * 10/2002 Voris ..... 482/142

FOREIGN PATENT DOCUMENTS

GB 2232089 A * 12/1990

OTHER PUBLICATIONS

Wolff, Bob, Mass Variations for Chest, Muscle & Fitness, Sep. 1995, pp. 126-129.*
Little, John, Chest Essentials, Muscle & Fitness, Sep. 1995, pp. 138-144.*
Leverage Machines by Nautilus, 10 degree Chest, Instruction Manual, date unknown.*
Nautilus Instruction Manual (1982) Mens' Chest/Pec Fly pp. 24, 25, 26, 27 and 28.
Nautilus Equipment Catalogue (1984) Chest Machines 1st and 2nd pages.
Nautilus The Next Generation (1989-1996) Mens' chest/Pec Fly; 10° Chest.
Nautilus 2st Super Smooth Technology (1996-present) Pec Fly.

* cited by examiner

WEIGHT TRAINING MACHINE FOR EXERCISING THE UPPER CHEST MUSCLES

RELATED APPLICATIONS

This application claims priority from U.S. Provisional Patent Application No. 60/299,676, filed 20 Jun. 2001, entitled "Weight Training Machine for Exercising the Upper Chest Muscles."

FIELD OF THE INVENTION

The present invention relates generally to exercise machines, and more specifically to exercise machines that exercise the chest muscles of a user.

BACKGROUND OF THE INVENTION

Exercise devices, and in particular weight training machines, typically include one or more mechanical members that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement for weight training is the so-called "pec fly" motion, in which an exerciser moves his arms from an extended position, in which the arms extend sideways from the shoulder, to a flexed position, in which the arms are moved in front of the chest. This exercise movement tends to work, inter alia, the pectoralis major, anterior deltoid, and serratus anterior muscles of the upper body.

Some pec fly machines include a frame, a seat that is mounted to the frame, and a pair of movement arms that are pivotally mounted to the frame. The user sits on the seat, extends his upper arms sideways from his shoulders, engages the movement arms with his elbows, forearms, or hands, and moves his upper arms (and, in turn, the movement arms) to the flexed position in front of his chest. This movement is resisted by weights or other resistance system.

In a typical pec fly machine, the user is seated and the movement arms pivot such that the plane of motion of the user's arms generally parallel to the plane defined by the user's shoulders. This movement is carried out by flexure of the pectoralis major, a fan-shaped muscle, the wider end of which is attached to the sternum. The portion of the pectoralis major that experiences the brunt of the exercise is that portion that is generally parallel with the plane of motion. As a result, the plane of motion of the typical pec fly machine described above described above can provide exercise for the upper portion of the pectoralis major, but typically does not not provide intense exercise for the lower portion of the pectoralis major (which is typically the thicker and more massive portion of the muscle).

SUMMARY OF THE INVENTION

The present invention is directed to a pec fly machine that can enable a user to exercise the lower portion of the pectoralis major intensely. In one embodiment, a machine of the present invention includes: a frame configured to rest on an underlying surface; a seat mounted to the frame; a backrest mounted to the frame above the seat, the seat and backrest being configured to receive a seated user; a pair of movement arm units pivotally interconnected with the frame and movable about respective generally parallel first and second axes of rotation; and a resistance system connected with the movement arm units. Each of the movement arms is configured to engage at least one of the elbows, forearms and hands of the user and is movable, within a range of motion plane that is generally normal to the first and second axes of rotation, between an extended position, in which the seated user's upper arms are extended sideways from the shoulders, and a flexed position, in which the user's upper arms are extended forwardly from the shoulders. The range of motion plane forms an angle of between about 30 and 80 degrees with the backrest. The resistance system provides resistance to rotation of the movement arm units relative to the frame as they move from the extended position to the flexed position. In this configuration, the exercise machine can intensify the exercise for the lower pectoralis major muscles of the upper chest.

In some embodiments of the present invention, the range of motion plane forms an angle of between about 40 and 60 degrees (preferably 50 degrees) with the backrest. It is preferred that the backrest be generally perpendicular to the seat. In other embodiments, the movement arms are configured to be engaged by the elbows of the user and include a swing arm and a rotary arm pivotally interconnected with the swing arm about a swing arm axis of rotation that is generally parallel with the first and second axes of rotation.

DETAILED DESCRIPTION OF THE INVENTION

Figure 1:
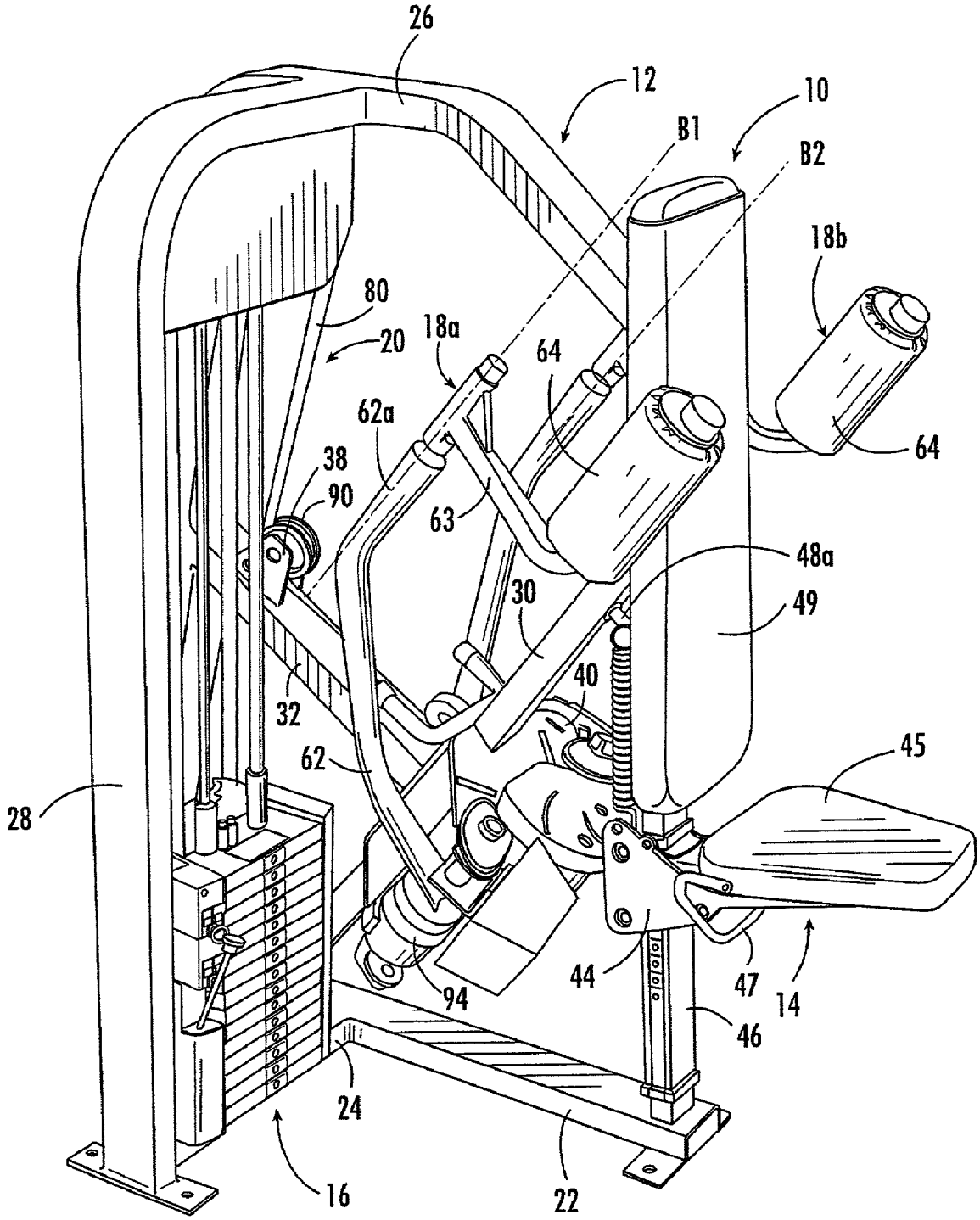
FIG. 1 is a perspective view of an embodiment of the exercise machine of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring to the figures, an exercise machine, designated broadly at 10, is illustrated in FIGS. 1–5. The machine 10 includes a frame 12, a seat assembly 14, a weight stack 16, a pair of movement arm units 18*a*, 18*b*, and a belt/pulley system 20. These components are described in detail below.

Figure 2:
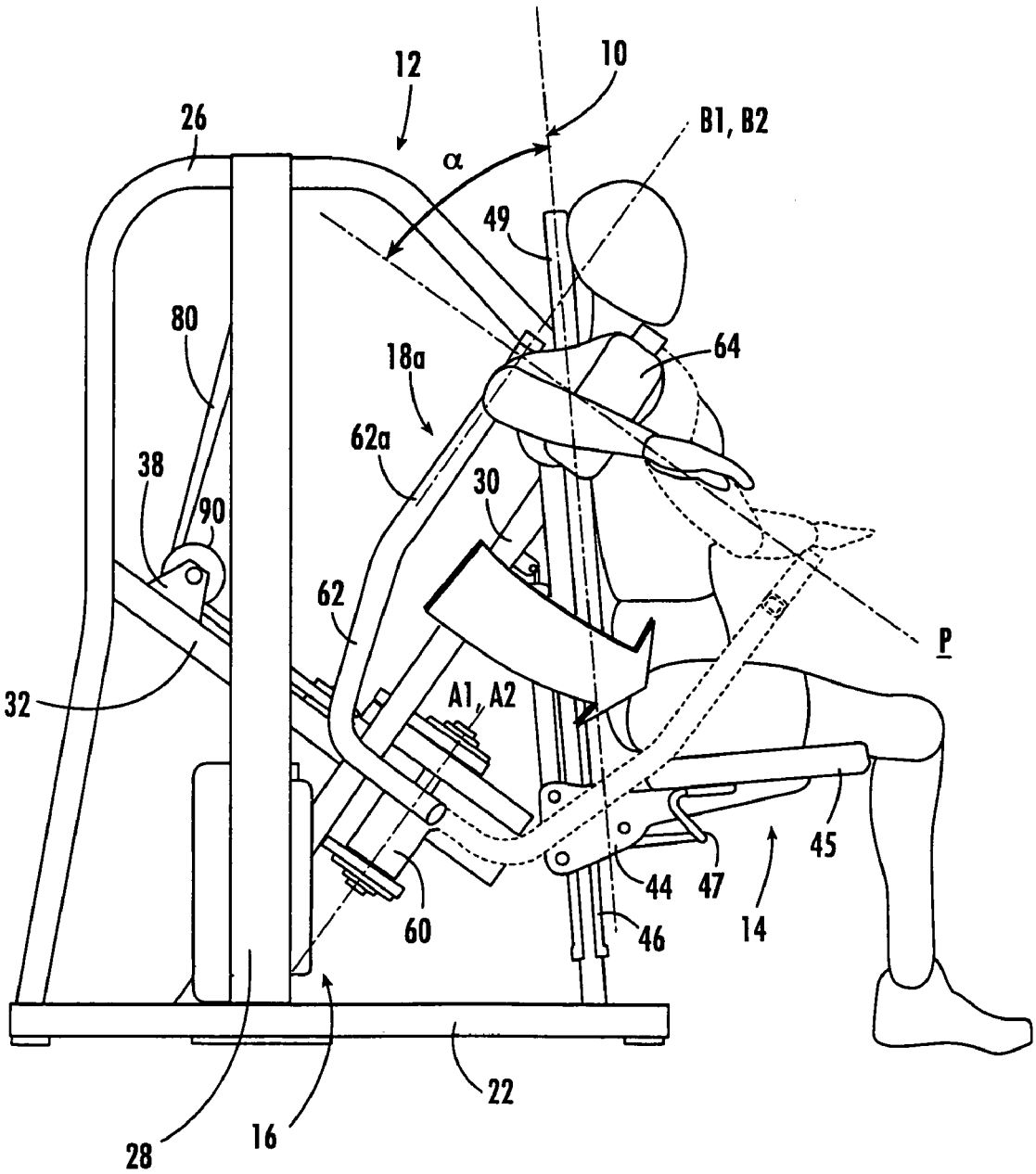
FIG. 2 is a side view of the exercise machine of FIG. 1, with the extended exercise position being shown in bold line and the flexed position being shown in phantom line.
Figure 3:
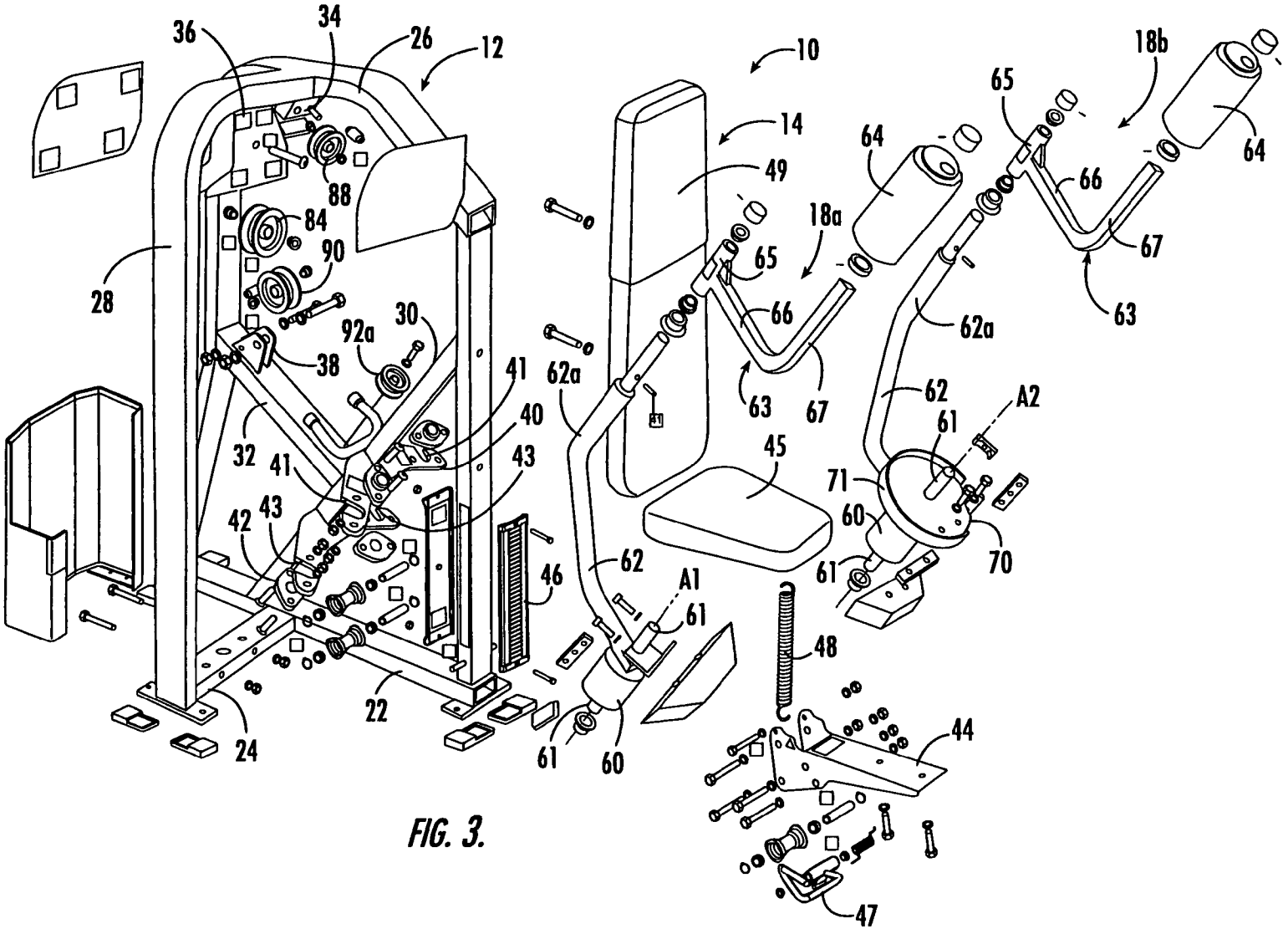
FIG. 3 is an exploded perspective view of the frame, seat assembly, and movement arm assemblies of the exercise machine of FIG. 1.

Referring to FIGS. 1–3, the frame 12 includes a longitudinal base member 22, a transverse base member 24 that abuts and extends transversely from the longitudinal base member 24, a longitudinal arch 26 that is attached at either end to the ends of the longitudinal base member 22, and a transverse support 28 that rises from the outer end of the transverse member 24 and extends horizontally to abut the longitudinal arch 26. A movement arm support 30 extends downwardly and rearwardly from an intermediate position on the longitudinal arch 26 to attach to the longitudinal base member 22 just rearwardly of the transverse base member 24. A pulley support 32 extends upwardly and rearwardly from an intermediate location on the movement arm support 30 to attach to the rear upright portion of the longitudinal arch 26.

Referring again to FIGS. 1–3, an upper pulley bracket 34 is mounted to the underside of the longitudinal arch 26 adjacent the transverse support 28. Similarly, a large pulley bracket 36 is mounted to the underside of the transverse support 28. A transitional pulley bracket 38 is mounted to the upper surface of the pulley support 32. Also, upper and lower movement arm brackets 40, 42 are mounted to the underside of the movement arm support 30.

Those skilled in this art will appreciate that the frame 12 may take alternative forms. For example, additional base and upright members may be employed, or certain components may be formed from multiple pieces.

Referring still to FIGS. 1–3, the seat assembly 14 includes a seat bracket 44 that supports a seat 45. The seat bracket 44 engages an adjustable seat track 46 that is attached to the front surface of the longitudinal arch 26; interaction between the seat bracket 44 and serrations in the track 46 enable the height of the seat 45 to be adjusted, with a handle 47 facilitating adjustment of the height of the seat 45. Also, a spring 48 attaches between the seat bracket 44 and a bracket 48*a* attached to the movement arm support 30 to bias the seat 45 upwardly, thereby providing a snug fit for the seat 45. A backrest 49 is fixed to the forward surface of the longitudinal arch 26 above the seat 45 and is substantially vertical in orientation, such that it is generally perpendicular to the seat 45.

Figure 4:
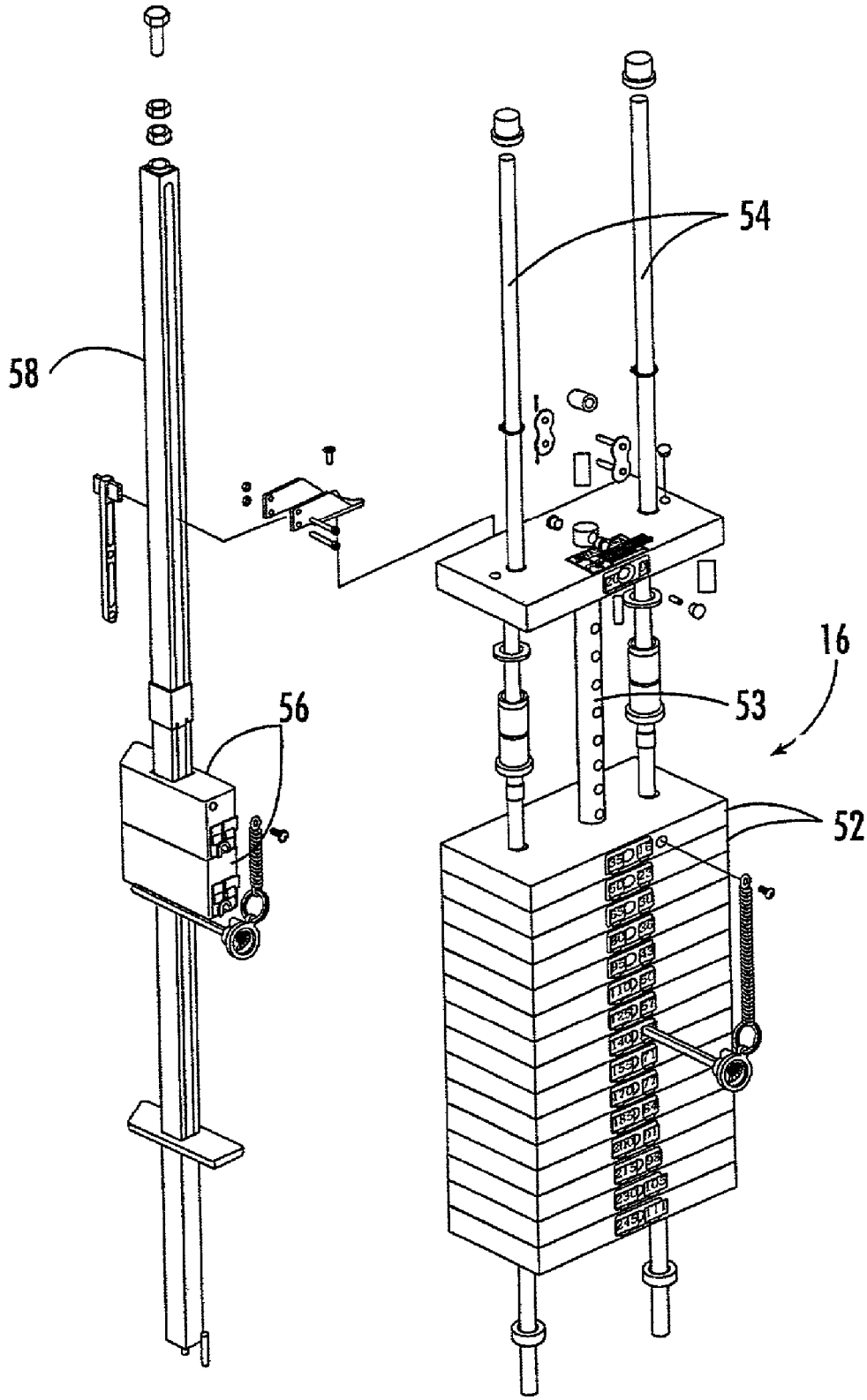
FIG. 4 is an exploded perspective view of the weight stack of the exercise machine of FIG. 1.

Referring now to FIGS. 1, 2 and 4, the weight stack 16 includes a set of weights 52 arranged in a vertical stack just above the transverse base member 24. A lifting rod 53 extends vertically through apertures in the weights 52 and is configured to receive a pin inserted between individual weights 52 that enables the user to select the number of weights to be used in the exercise. The weight stack 16 also includes guide rods 54 that extend vertically through the weights 52 to guide the weights 52 along a vertical path during exercise. Weight stacks of this variety are well known to those skilled in this art and need not be described in detailed herein. In addition, the machine 10 includes a set of auxiliary weights 56 that slide along a vertical guide rod 58 and that can be temporarily connected with the selected weights 52 to provide incremental weight during exercise. Again, auxiliary weight systems of this type are well known to those skilled in this art and need not be described in detail herein. An exemplary machine having such a weight stack is a leg extension machine available from Nautilus HPS, Inc. (Independence, Va.) under the trade name NITRO™.

Those skilled in this art will appreciate that other resistance systems may be employed with the present invention. For example, other weight stack configurations, friction-imparting devices, variable viscosity devices, air drag-based resistance devices, and the like, may also be employed with a machine of the present invention. Exemplary resistance devices include those illustrated in U.S. Pat. Nos. 5,810,696; 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

Referring again to FIGS. 1–3, each of the movement arm assemblies 18*a*, 18*b* includes a cylindrical mounting hub 60, a tripartite swing arm 62, a rotary arm 63, and an engagement pad 64. Each mounting hub 60 includes mounting pins 61 that extend longitudinally from each end thereof and that are received in slots 41, 43 in the upper and lower movement arm brackets 40, 42, thereby defining a respective axis of rotation A1, A2. The swing arm 62 is mounted to the forward end of the hub 60. Each swing arm 62 terminates in a forward segment 62*a* that extends in a direction parallel to that of the axes A1, A2. The L-shaped rotary arm 63 has a sleeve bearing 65 that is rotatably attached to the forward segment 62*a*, a transitional segment 66, and a pad segment 67 extends in a direction parallel to the axes of rotation A1, A2. Each rotary arm 63 is free to rotate about a respective rotary arm axis of rotation B1, B2. The engagement pad 64 fits upon the pad segment 67 and is free to rotate thereon; the engagement pad 64 provides a location for the exerciser to place his elbows during exercise.

The movement arm assembly 18*b* differs from the movement arm assembly 18*a* in that the movement arm assembly 18*b* also includes a cam 70 that rotates about the axis A2. The cam 70 has a perimeter camming surface 71 that is generally normal to the axis of rotation A2.

Those skilled in this art will appreciate that other configurations for the movement arm assemblies 18*a*, 18*b* may be employed with the present invention. For example, the movement arm assemblies 18*a*, 18*b* may be configured with a swing arm that lacks a pivotally interconnected rotary arm. Also, a movement arm assembly 18*a*, 18*b* may be configured to engage the forearm or hand of the user. The configuration of the cam 70 may differ, particularly if a different resistance curve for exercise resistance is desired.

Figure 5:
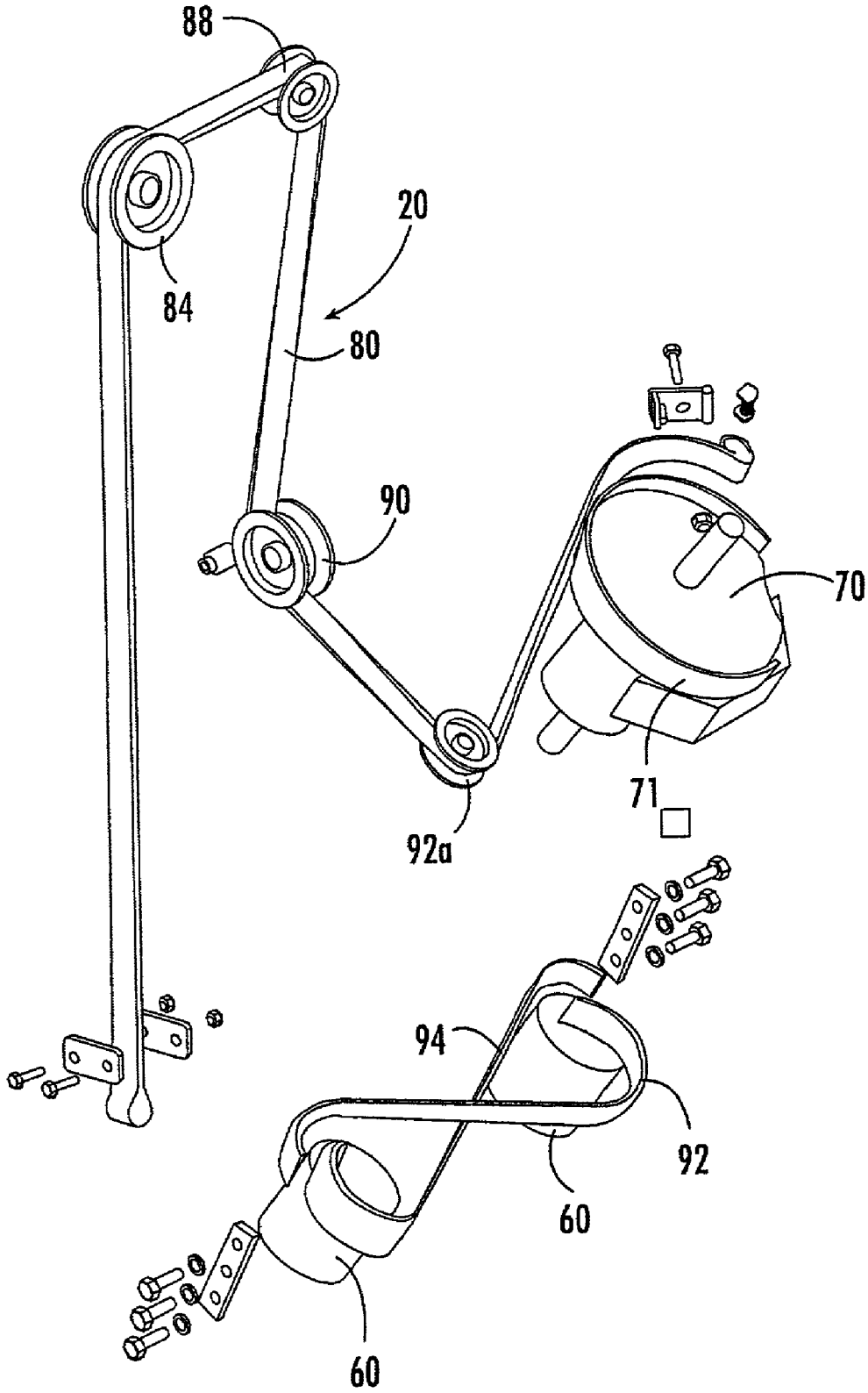
FIG. 5 is a perspective view of the belt/pulley system of the exercise machine of FIG. 1.

Referring now to FIG. 5, the belt/pulley system 20 includes a belt 80 that is attached to the lifting member 53 of the weight stack 16. The belt 80 extends upwardly to engage a pulley 84 that is mounted to the large pulley bracket 36, horizontally to engage an upper pulley 88 mounted to the upper pulley bracket 34, downwardly to engage a transitional pulley 90 that is mounted to the transitional pulley bracket 38, and forwardly to engage a diverting pulley 92*a* mounted to the upper surface of the pulley support 32. The belt 80 terminates by wrapping around the rear-facing portion of the camming surface 71 of the cam 70.

Referring again to FIG. 5, the belt/pulley system 20 also includes two belts 92, 94 that form a figure-8 around the mounting hubs 60. More specifically, each belt 92, 94 is fixed at one end to a respective mounting hub 60, passes around the front surface thereof, travels to the rear surface of the opposite mounting hub 60, and is fixed thereto.

The skilled artisan will recognize that other systems for interconnecting the weight stack to the movement arm units may be employed. For example, cables or chains may be substituted for belts. As another alternative, pulley locations may differ, and/or other varieties of components that can engage a belt and support a change of direction thereof, such as rollers, gears, sprockets, or stationary cams, may also be employed with this invention.

In operation, the exerciser selects a desired number of weights 52 from the weight stack 16. He then sits on the seat 45 and grasps the engagement pads 64 in the crooks of his elbows (see FIG. 2). Exercise is carried out by pulling the engagement pads forwardly and toward the center of the chest (shown in FIG. 2 in phantom line). Because the rotary arms 63 are free to rotate relative to the swing arms 62, the pad 64 can remain in the crook of the exerciser's elbow, thereby following an arcuate path of variable radius. This path defines a plane P that is generally normal to the axes of rotation A1, A2, B1, B2 which in turn defines an angle $\alpha$ of between about 30 and 80 degrees (preferably between about 40 and 60 degrees, and more preferably about 50 degrees) with the backrest 49. As a result of this angular relationship, the exercise has the effect of working the lower portion of the pectoralis major muscle in a more intense manner than many other weight training machines designed to exercise the muscles of the upper chest. In addition, the exercise works the upper portion of the pectoralis major, the anterior deltoid, and the serratus anterior.

As the rotary arms 63 move forwardly and inwardly, the swing arms 62 rotate relative to the upper and lower movement arm brackets 40, 42. Notably, the mounting hubs 60 rotate with the swing arms 62; the figure-8 belts 92, 94 synchronize the motion of the swing arms 62 by keeping the rotation of the mounting hubs 60 of each swing arm 62 essentially the same.

Also, as the movement arm assembly 18*b* rotates, in turn the cam 70 rotates (clockwise as viewed from the front of the machine 10). Rotation of the cam 70 causes the belt 80 to be taken up on the camming surface 71. This "shortening" of the belt 80 draws the selected weights 52 upwardly, thereby providing resistance to the exerciser. The resistance experienced by the exerciser can be modified during the exercise "stroke" by changing the configuration of the camming surface 71.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. An exercise machine for exercising the lower chest muscles of a user, comprising:

a frame configured to rest on an underlying surface;

a seat mounted to the frame;

a backrest mounted to the frame above the seat, the seat and backrest being configured to receive a seated user;

a pair of movement arm units pivotally interconnected with the frame and movable about respective generally parallel first and second axes of rotation, each of the pair of movement arm units being movable, within a range of motion plane that is generally normal to the axes of rotation, between an extended position, in which the seated user's upper arms are extended sideways from the shoulders, and a flexed position, in which the user's upper arms are extended forwardly from the shoulders, wherein each movement arm unit includes a swing arm pivotally interconnected with the frame and a rotary arm that is pivotally interconnected with the swing arm, each rotary arm pivoting relative to its corresponding swing arm about a respective rotary arm axis of rotation that is generally parallel to the first and second axes of rotation, and wherein each rotary arm includes an engagement pad configured to engage the crook of the user's elbows;

wherein the range of motion plane forms an angle of between about 30 and 80 degrees with the backrest; and a resistance system connected with the movement arm units that provides resistance to rotation of the movement arm units relative to the frame as they move from the extended position to the flexed position.

2. The exercise machine defined in claim 1, wherein said resistance system comprises a weight stack.

3. The exercise machine defined in claim 2, wherein one of the movement arm units includes a cam, and wherein the weight stack is connected to the movement arm unit cam via a belt.

4. The exercise machine defined in claim 3, wherein each of the movement arm units includes a hub that rotates about a respective first or second axis of rotation, and further comprising a pair of belts attached to the hubs in a figure-8 configuration.

5. The exercise machine defined in claim 1, wherein the backrest is generally perpendicular to the seat.

6. The exercise machine defined in claim 1, wherein the angle between the range of motion plane and the backrest is between about 40 and 60 degrees.

7. The exercise machine defined in claim 1, wherein the angle between the range of motion plane and the backrest is about 50 degrees.

8. The exercise machine defined in claim 1, wherein each swing arm includes a forward segment that is generally parallel with the first and second axes of rotation.

9. The exercise machine defined in claim 8, wherein the engagement pads are mounted on pad segments that are generally parallel to the first and second axes of rotation.

10. An exercise machine for exercising the chest muscles of a user, comprising:

a frame configured to rest on an underlying surface;

a seat mounted to the frame;

a backrest mounted to the frame above the seat, the seat and backrest being configured to receive a seated user;

a pair of movement arm units pivotally interconnected with the frame and movable about respective generally parallel first and second axes of rotation, each of the movement arm units being configured to engage the crooks of the elbows of the user, each of the pair of movement arm units being movable, within a range of motion plane that is generally normal to the axes of rotation, between an extended position, in which the seated user's upper arms are extended sideways from the shoulders, and a flexed position, in which the user's upper arms are extended forwardly from the shoulders, wherein each movement arm unit includes a swing arm pivotally interconnected with the frame and a rotary arm that is pivotally interconnected with the swing arm;

wherein the range of motion plane forms an angle of between about 40 and 60 degrees with the backrest; and a resistance system connected with the movement arm units that provides resistance to rotation of the movement arm units relative to the frame as they move from the extended position to the flexed position.

11. The exercise machine defined in claim 10, wherein said resistance system comprises a weight stack.

12. The exercise machine defined in claim 11, wherein one of the movement arm units includes a cam, and wherein the weight stack is connected to the movement arm unit cam via a belt.

13. The exercise machine defined in claim 12, wherein each of the movement arm units includes a hub that rotates about a respective first or second axis of rotation, and further comprising a pair of belts attached to the hubs in a figure-8 configuration.

14. The exercise machine defined in claim 10, wherein the backrest is generally perpendicular to the seat.

15. The exercise machine defined in claim 10, wherein the angle between the range of motion plane and the backrest is about 50 degrees.

16. The exercise machine defined in claim 10, wherein each rotary arm pivots relative to its corresponding swing arm about a respective rotary arm axis of rotation, and wherein the rotary arm axes of rotation are generally parallel to the first and second axes of rotation.

17. The exercise machine defined in claim 16, wherein each swing arm includes a forward segment that is generally parallel with the first and second axes of rotation.

18. The exercise machine defined in claim 17, wherein each rotary arm includes an engagement pad configured to engage the user's elbows, and wherein the engagement pads are mounted on pad segments that are generally parallel to the first and second axes of rotation.

19. An exercise machine for exercising the chest muscles of a user, comprising:

a frame configured to rest on an underlying surface;

a seat mounted to the frame;

a backrest mounted to the frame above and generally perpendicular to the seat, the seat and backrest being configured to receive a seated user;

a pair of movement arm units pivotally interconnected with the frame and movable about respective generally parallel first and second axes of rotation, each of the movement arms being configured to engage the crook of the elbow of the user, each of the pair of movement arm units being movable, within a range of motion plane that is generally normal to the axes of rotation, between an extended position, in which the seated user's upper arms are extended sideways from the shoulders, and a flexed position, in which the user's upper arms are extended forwardly from the shoulders, wherein each movement arm unit includes a swing arm pivotally interconnected with the frame and a rotary arm that is pivotally interconnected with the swing arm;

wherein the range of motion plane forms an angle of between about 40 and 60 degrees with the backrest; and a resistance system connected with the movement arm units that provides resistance to rotation of the movement arm units relative to the frame as they move from the extended position to the flexed position.

20. The exercise machine defined in claim 19, wherein said resistance system comprises a weight stack.

21. The exercise machine defined in claim 20, wherein one of the movement arm units includes a cam, and wherein the weight stack is connected to the movement arm unit cam via a belt.

22. The exercise machine defined in claim 21, wherein each of the movement arm units includes a hub that rotates about a respective first or second axis of rotation, and further comprising a pair of belts attached to the hubs in a figure-8 configuration.

23. The exercise machine defined in claim 19, wherein the angle between the range of motion plane and the backrest is about 50 degrees.

24. The exercise machine defined in claim 19, wherein each rotary arm pivots relative to its corresponding swing arm about a respective rotary arm axis of rotation, and wherein the rotary arm axes of rotation are generally parallel to the first and second axes of rotation.

25. The exercise machine defined in claim 24, wherein each swing arm includes a forward segment that is generally parallel with the first and second axes of rotation.

26. The exercise machine defined in claim 25, wherein each rotary arm includes an engagement pad configured to engage the user's elbows, and wherein the engagement pads are mounted on pad segments that are generally parallel to the first and second axes of rotation.

* * * * *